US008920124B2

(12) United States Patent
Lee

(10) Patent No.: US 8,920,124 B2
(45) Date of Patent: Dec. 30, 2014

(54) TURBINE BLADE WITH CONTOURED CHAMFERED SQUEALER TIP

(71) Applicant: Ching-Pang Lee, Cincinnati, OH (US)

(72) Inventor: Ching-Pang Lee, Cincinnati, OH (US)

(73) Assignee: Siemens Energy, Inc., Orlando, FL (US)

( * ) Notice: Subject to any disclaimer, the term of this patent is extended or adjusted under 35 U.S.C. 154(b) by 23 days.

(21) Appl. No.: 13/767,019

(22) Filed: Feb. 14, 2013

(65) Prior Publication Data

US 2014/0227103 A1 Aug. 14, 2014

(51) Int. Cl.
*F01D 5/20* (2006.01)
*F01D 5/14* (2006.01)

(52) U.S. Cl.
CPC ... *F01D 5/14* (2013.01); *F01D 5/20* (2013.01)
USPC ..... 416/97 R

(58) Field of Classification Search
CPC ..... F01D 5/20; F01D 5/187; F01D 5/186; F01D 5/18; F01D 5/005; F01D 5/145; F01D 11/08; F01D 5/141
USPC ..... 416/97 R, 92, 228, 224, 96 R, 231 R, 416/232; 415/173.1, 115, 176
See application file for complete search history.

(56) References Cited

U.S. PATENT DOCUMENTS 5,356,265 A * 10/1994 Kercher ..... 416/97 R
5,503,527 A 4/1996 Lee et al.
5,733,102 A 3/1998 Lee et al.
5,738,491 A 4/1998 Lee et al.
5,927,946 A 7/1999 Lee
5,997,251 A 12/1999 Lee
6,086,328 A 7/2000 Lee
6,422,821 B1 7/2002 Lee et al.
6,602,052 B2 * 8/2003 Liang ..... 416/97 R
6,634,860 B2 10/2003 Lee et al.
6,672,829 B1 1/2004 Cherry et al.
7,270,514 B2 9/2007 Lee
7,281,894 B2 10/2007 Lee et al.
7,287,959 B2 10/2007 Lee et al.
7,290,986 B2 11/2007 Stegemiller et al.
7,413,407 B2 * 8/2008 Liang ..... 416/97 R
7,510,376 B2 3/2009 Lee et al.
7,607,893 B2 10/2009 Lee et al.
7,686,578 B2 3/2010 Klasing et al.

(Continued)

FOREIGN PATENT DOCUMENTS

EP 1270873 A2 1/2003
EP 2141327 A2 1/2010

*Primary Examiner* — Edward Look
*Assistant Examiner* — Eldon Brockman

(57) ABSTRACT

A squealer tip formed from a pressure side tip wall and a suction side tip wall extending radially outward from a tip of the turbine blade is disclosed. The pressure and suction side tip walls may be positioned along the pressure sidewall and the suction sidewall of the turbine blade, respectively. The pressure side tip wall may include a chamfered leading edge with film cooling holes having exhaust outlets positioned therein. An axially extending tip wall may be formed from at least two outer linear surfaces joined together at an intersection forming a concave axially extending tip wall. The axially extending tip wall may include a convex inner surface forming a radially outer end to an inner cavity forming a cooling system. The cooling system may include one or more film cooling holes in the axially extending tip wall proximate to the suction sidewall, which promotes increased cooling at the pressure and suction sidewalls.

19 Claims, 4 Drawing Sheets

(56) References Cited

U.S. PATENT DOCUMENTS

| | | | | |
|---|---|---|---|---|
| 7,819,626 | B2 | 10/2010 | Lee et al. | |
| 2002/0090301 | A1 | 7/2002 | Lee et al. | |
| 2002/0141868 | A1 | 10/2002 | Lee et al. | |
| 2008/0044289 | A1 | 2/2008 | Klasing et al. | |
| 2009/0324422 | A1 | 12/2009 | Klasing et al. | |
| 2010/0047057 | A1* | 2/2010 | Kopmels | 415/115 |
| 2010/0135822 | A1* | 6/2010 | Marini et al. | 416/97 R |
| 2010/0221122 | A1 | 9/2010 | Klasing et al. | |
| 2012/0282108 | A1* | 11/2012 | Lee et al. | 416/97 R |
| 2013/0142668 | A1 | 6/2013 | Bacha et al. | |

* cited by examiner

TURBINE BLADE WITH CONTOURED CHAMFERED SQUEALER TIP

STATEMENT REGARDING FEDERALLY SPONSORED RESEARCH OR DEVELOPMENT

Development of this invention was supported in part by the United States Department of Energy, Advanced Turbine Development Program, Contract No. DE-FC26-05NT42644. Accordingly, the United States Government may have certain rights in this invention.

FIELD OF THE INVENTION

This invention is directed generally to turbine blades, and more particularly to airfoil tips for turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,600 degrees Fahrenheit. Typical turbine combustor configurations expose turbine blade assemblies to these high temperatures. As a result, turbine blades must be made of materials capable of withstanding such high temperatures.

Typically, turbine blade is formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The tip of a turbine blade often has a tip feature to reduce the size of the gap between ring segments and blades in the gas path of the turbine to prevent tip flow leakage, which reduces the amount of torque generated by the turbine blades. The tip features are often referred to as squealer tips and are frequently incorporated onto the tips of blades to help reduce performance losses between turbine stages. These features are designed to minimize the leakage between the blade tip and the ring segment.

SUMMARY OF THE INVENTION

A squealer tip formed from a radially extending pressure side tip wall and a radially extending suction side tip wall extending radially outward from a tip of a turbine blade formed from an axially extending tip wall is disclosed. The radially extending pressure and suction side tip walls may be positioned along a pressure sidewall and a suction sidewall of the turbine blade, respectively. The radially extending pressure side tip wall may include a chamfered leading edge with one or more film cooling holes having exhaust outlets positioned therein. An axially extending tip wall may be formed from at least two outer linear surfaces joined together at an intersection forming a concave axially extending tip wall. The axially extending tip wall may include a convex inner surface forming a radially outer end to an inner cavity forming a cooling system. The cooling system may include one or more film cooling holes in the axially extending tip wall proximate to the suction sidewall, which promotes increased cooling at the pressure and suction sidewalls.

The turbine blade may be formed from a generally elongated airfoil having a leading edge, a trailing edge, a tip at a first end, and a root coupled to the blade at an end generally opposite the first end for supporting the blade and for coupling the blade to a disc. The turbine blade may also be formed from a pressure sidewall extending from the leading edge to the trailing edge and a suction sidewall extending from the leading edge to the trailing edge and positioned on an opposite side of the generally elongated airfoil from the pressure sidewall. One or more cavities forming an internal cooling system may be included in the turbine blade.

A squealer tip may be positioned at the first end. The squealer tip may be formed from a radially extending pressure side tip wall with an outer surface that is flush with an outer surface of the pressure sidewall, a radially extending suction side tip wall with an outer surface that is flush with an outer surface of the suction sidewall, and an axially extending tip wall extending between the pressure side tip wall and the suction side tip wall. The axially extending tip wall may be formed from two or more outer linear surfaces joined together at an intersection that form a concave axially extending tip wall. The intersection at which the two outer linear surfaces forming the axially extending tip wall are joined may be positioned radially inward from an intersection of an inner surface of the radially extending pressure side tip wall and an outer first surface of the axially extending tip wall and radially inward from an intersection of an inner surface of the radially extending suction side tip wall and an outer second surface of the axially extending tip wall.

The radially extending pressure side tip wall may include a chamfered surface positioned at an acute angle relative to the outer surface of the generally elongated airfoil forming the pressure sidewall. The chamfered surface of the radially extending pressure side tip wall may only extend for a portion of an entire length of the radially extending pressure side tip wall. The radially extending pressure side tip wall may extend from the leading edge and may terminate at the trailing edge. The turbine blade may also include one or more film cooling holes positioned in the radially extending pressure side tip wall with an outlet in the outer surface in the radially extending pressure side tip wall and an inlet that couples the film cooling hole with the cavity forming the internal cooling system. The outlet of the film cooling hole may be positioned in the chamfered surface of the radially extending pressure side tip wall.

The radially extending suction side tip wall may extend from the trailing edge toward the leading edge of the generally elongated airfoil, terminate at the leading edge and may be coupled to the radially extending pressure side tip wall. One or more film cooling holes may be positioned in an outer linear surface of the axially extending tip wall in contact with the radially extending suction side tip wall. The film cooling hole may include an outlet in the axially extending tip wall and an inlet that couples the film cooling hole with the cavity forming the internal cooling system. An inner surface of the axially extending tip wall which forms a radially outer boundary of the cavity forming the internal cooling system may have a convex surface with radially outermost points of the convex surface at intersections with the pressure and suction sidewalls. The cavity forming the internal cooling system may include a radially extending midregion rib dividing the internal cooling system into pressure and suction sides.

An advantage of this invention is that the convex inner surface of the axially extending tip wall improves cooling at the tip turn adjacent to the pressure and suction sidewalls, which are subjected to the high temperature hot gas path.

Another advantage of this invention is that the concave outer surface forming the squealer tip forms a deep external tip cavity that operates for static pressure recovery and tip leakage flow reduction.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
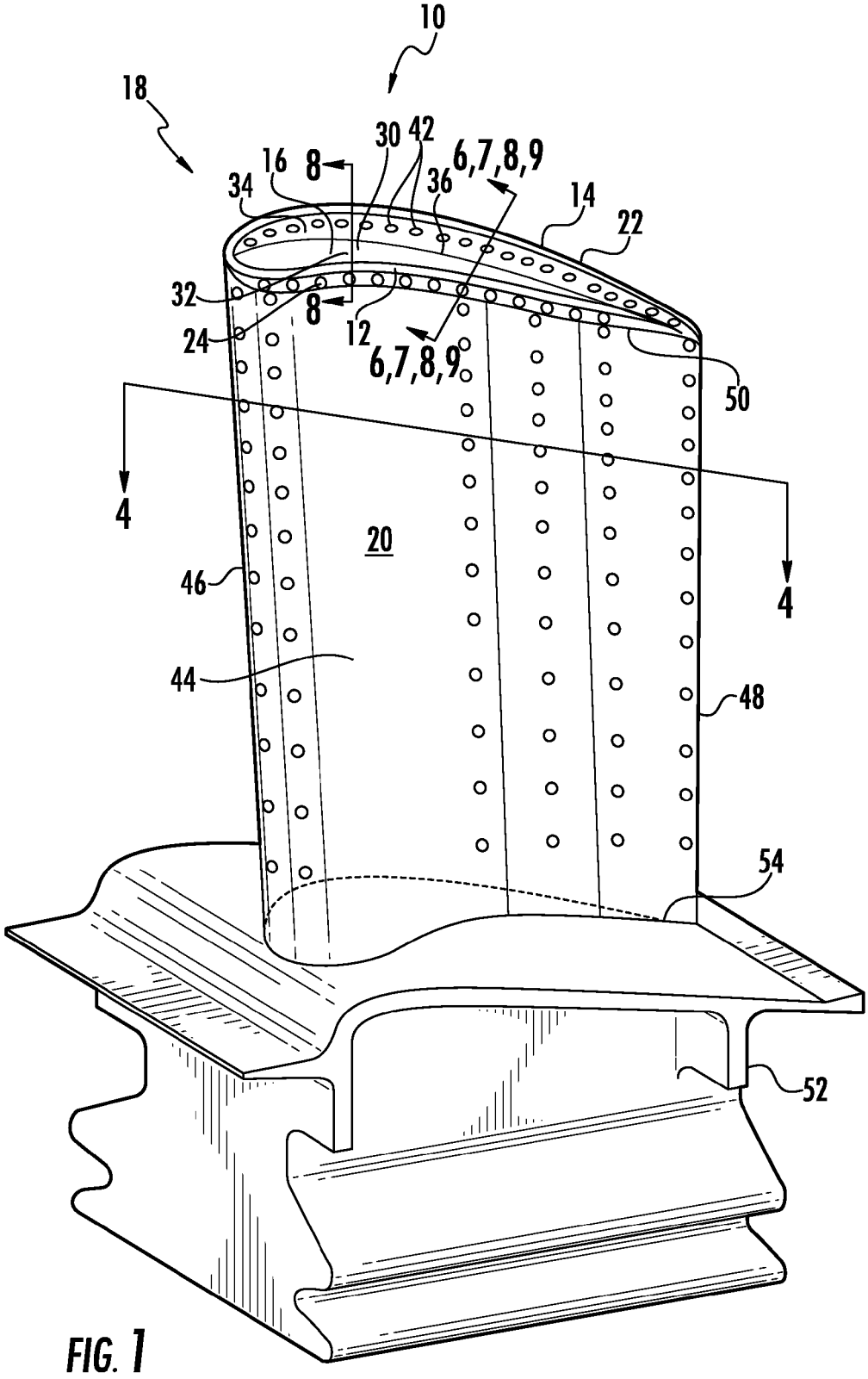
FIG. 1 is a perspective view of a turbine blade with a squealer tip.
Figure 2:
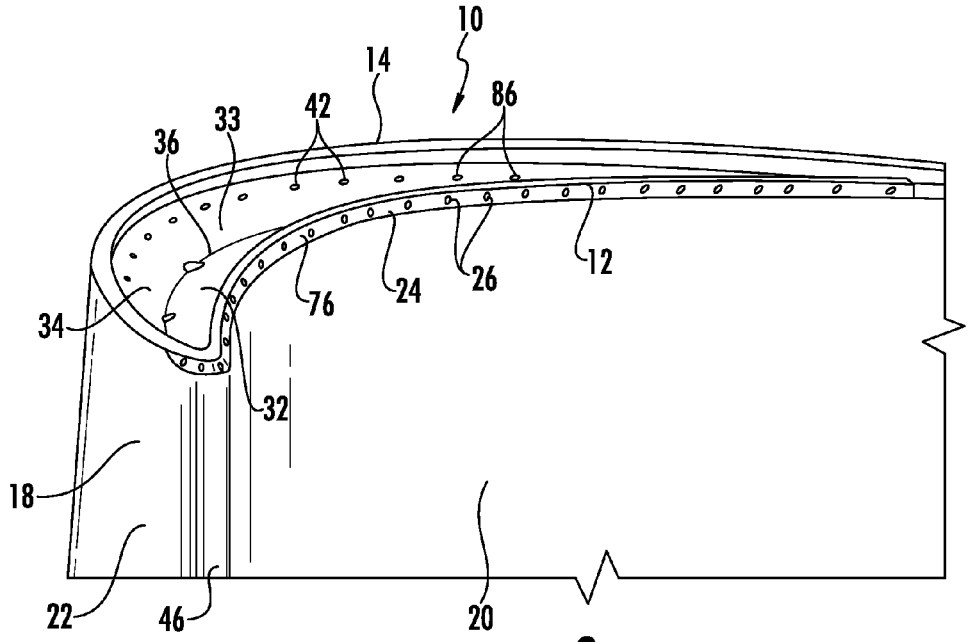
FIG. 2 is a partial perspective detailed view of the squealer tip at the leading edge of the turbine blade shown in FIG. 1.
Figure 3:
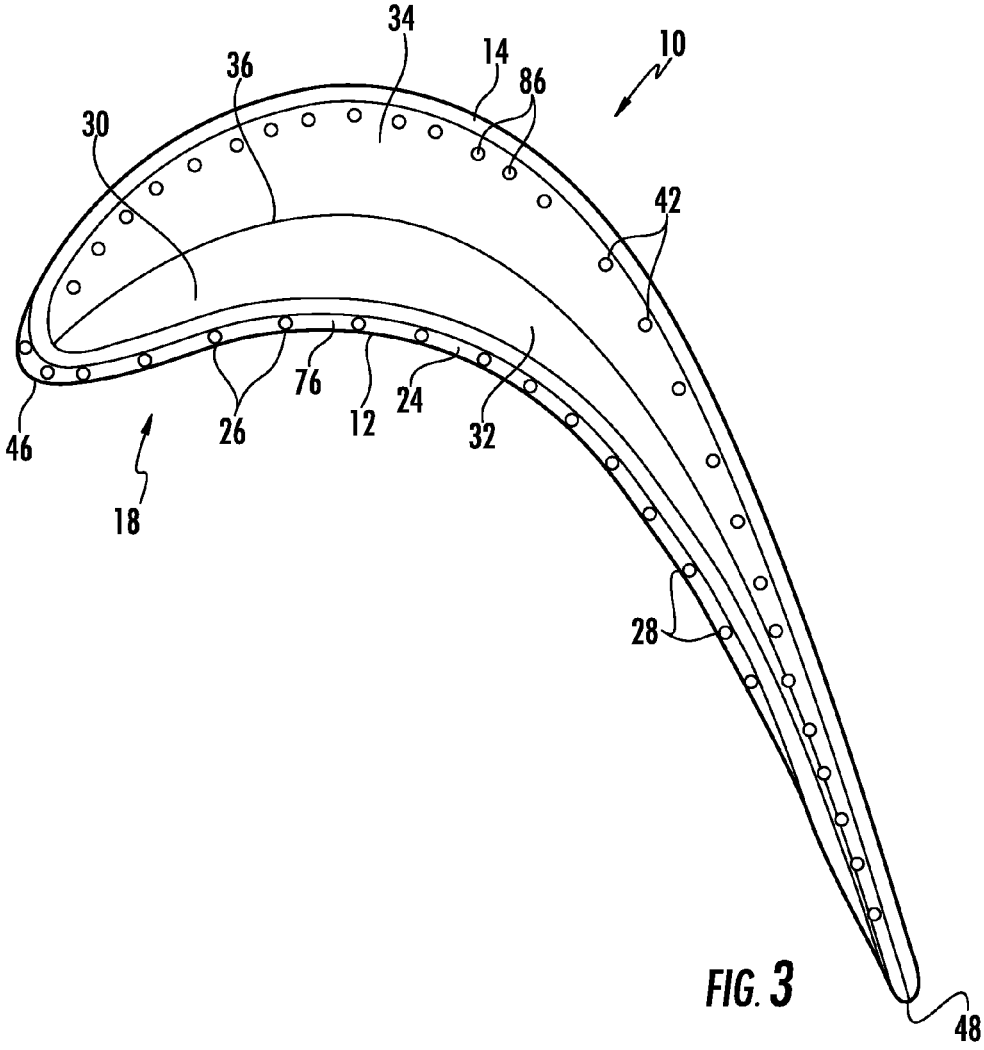
FIG. 3 is top view of the squealer tip shown in FIG. 1.
Figure 4:
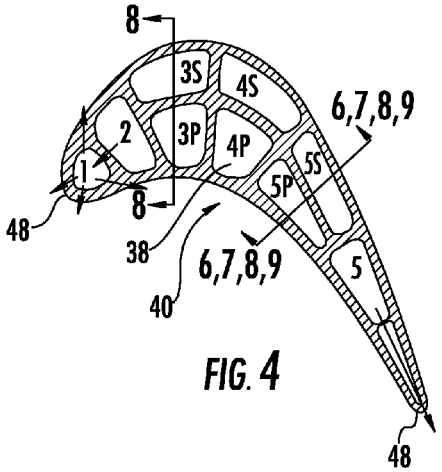
FIG. 4 is a cross-sectional view of the turbine blade tip taken at section line 4-4 in FIG. 1.

As shown in FIGS. 1-9, a squealer tip 10 formed from a radially extending pressure side tip wall 12 and a radially extending suction side tip wall 14 extending radially outward from a tip 16 of a turbine blade 18 formed from an axially extending tip wall 30 is disclosed. The radially extending pressure and suction side tip walls 12, 14 may be positioned along a pressure sidewall 20 and a suction sidewall 22 of the turbine blade 18, respectively. The radially extending pressure side tip wall 12 may include a chamfered leading edge 24 with one or more film cooling holes 26 having exhaust outlets 28 positioned therein. An axially extending tip wall 30 may be formed from at least two outer linear surfaces 32, 34 joined together at an intersection 36 forming a concave axially extending tip wall. The axially extending tip wall 30 may include a convex inner surface 33 forming a radially outer end to an inner cavity 38 forming a cooling system 40. The cooling system 38 may include one or more film cooling holes 42 in the axially extending tip wall 30 proximate to the suction sidewall 22, which promotes increased cooling at the pressure and suction sidewalls 20, 22.

Figure 5:
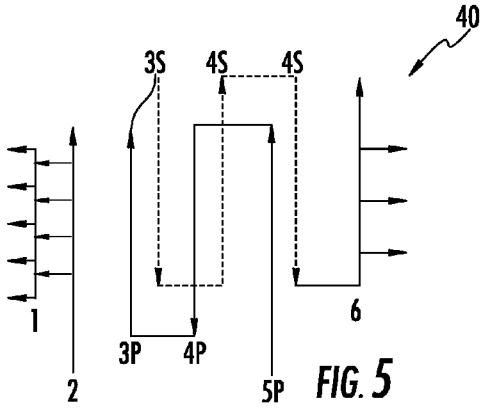
FIG. 5 is a schematic diagram of the cooling system shown in FIG. 4.

As shown in FIG. 1, the turbine blade 18 may be formed from a generally elongated airfoil 44 having a leading edge 46 and a trailing edge 48. The generally elongated airfoil 44 may include a tip 16 at a first end 50 and a root 52 coupled to the blade 44 at a second end 54 generally opposite the first end 50 for supporting the blade 44 and for coupling the blade 44 to a disc. An internal cooling system 40, as shown in FIGS. 4-9 may be formed from at least one cavity 38 positioned within the generally elongated airfoil 44. The cooling system 40 may be configured as shown in FIG. 5 or may have any appropriate configuration to cool the turbine blade 18 during use in an operating gas turbine engine. The turbine blade 18 and its related components listed above may be formed from any appropriate material already known in the art or yet to be discovered or identified.

As shown in FIG. 1, the turbine blade 18 may also include a pressure sidewall 20 extending from the leading edge 46 to the trailing edge 48 and a suction sidewall 22 extending from the leading edge 46 to the trailing edge 48 and positioned on an opposite side of the generally elongated airfoil 44 from the pressure sidewall 20 and the cavity 38 forming the internal cooling system 40.

The squealer tip 10 may be positioned at the first end 50 and may be formed from a radially extending pressure side tip wall 12 with an outer surface 56 that is flush with an outer surface 58 of the pressure sidewall 20. The radially extending pressure side tip wall 12 and the radially extending suction side tip wall 14 may have any appropriate height and width. In at least one embodiment, as shown in FIGS. 6-9, the radially extending pressure side tip wall 12 or the radially extending suction side tip wall 14, or both, may have a height to width ratio of between about 2:1 and 1:2, and in at least one embodiment, may be about 1:1. The squealer tip 10 may also include a radially extending suction side tip wall 14 with an outer surface 60 that is flush with an outer surface 62 of the suction sidewall 22. The axially extending tip wall 30 may extend between the pressure side tip wall 12 and the suction side tip wall 14. The axially extending tip wall 30 may be formed from at least two outer linear surfaces 32, 34 joined together at an intersection 36 that form a concave axially extending tip wall 30. The intersection 36 at which the two outer linear surfaces 32, 34 forming the axially extending tip wall 30 are joined may be positioned radially inward from an intersection 64 of an inner surface 66 of the radially extending pressure side tip wall 12 and an outer first surface 68 of the axially extending tip wall 30 and radially inward from an intersection 70 of an inner surface 72 of the radially extending suction side tip wall 14 and an outer second surface 74 of the axially extending tip wall 30.

As shown in FIGS. 1-3, 8 and 9, the radially extending pressure side tip wall 12 may include a chamfered surface 76 positioned at an acute angle relative to the outer surface 58 of the generally elongated airfoil 44 forming the pressure sidewall 20. The chamfered surface 76 of the radially extending pressure side tip wall 12 may only extend for a portion of an entire length of the radially extending pressure side tip wall 12. In another embodiment, the chamfered surface 76 of the radially extending pressure side tip wall 12 may extend for the entire length of the radially extending pressure side tip wall 12. The radially extending pressure side tip wall 12 may extend from the leading edge 46 and may terminate at the trailing edge 48. The radially extending suction side tip wall 14 may extend from the trailing edge 48 toward the leading edge 46 of the generally elongated airfoil 44, terminate at the leading edge 46 and may be coupled to the radially extending pressure side tip wall 12.

As shown in FIGS. 1-3, 8 and 9, one or more film cooling holes 26 may be positioned in the radially extending pressure side tip wall 12 with an outlet 28 in the outer surface 56 in the radially extending pressure side tip wall 12 and an inlet 82 that couples the film cooling hole 26 with the cavity 38 forming the internal cooling system 40. The outlet 28 of the film cooling hole 26 may be positioned in the chamfered surface 76 of the radially extending pressure side tip wall 12. The film cooling holes 26 positioned in the radially extending pressure side tip wall 12 may extend at an acute angle relative to the outer surface 56 of the radially extending pressure side tip wall 12. In addition, the film cooling hole 26 may extend into the radially extending pressure side tip wall 12 at an acute angle relative to the chamfered surface 76 of the radially extending pressure side tip wall 12. In another embodiment, the film cooling hole 26 may extend into the radially extending pressure side tip wall 12 generally orthogonal to the chamfered surface 76 of the radially extending pressure side tip wall 12.

The squealer tip 10 may also include one or more film cooling holes 42 positioned in the outer linear surface 34 of the axially extending tip wall 30 in contact with the radially extending suction side tip wall 14. The film cooling hole 42 may include an outlet 86 in the axially extending tip wall 30 and an inlet 88 that couples the film cooling hole 42 with the cavity 38 forming the internal cooling system 40.

Figure 6:
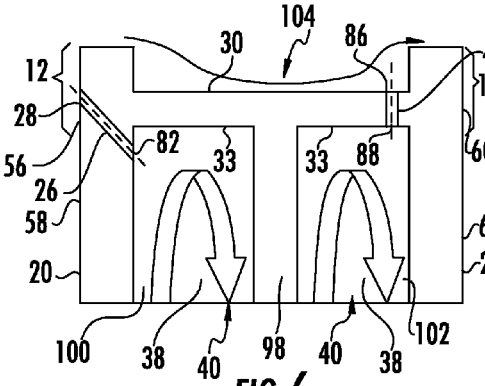
FIG. 6 is a partial cross-sectional view of the squealer tip taken at section line 6-6 in FIG. 4.
Figure 7:
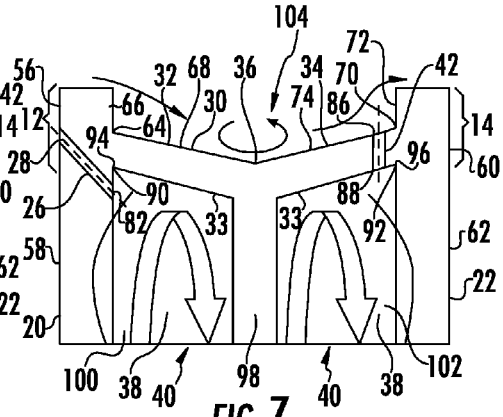
FIG. 7 is a partial cross-sectional view of another embodiment of the squealer tip taken at section line 7-7 in FIG. 4.
Figure 8:
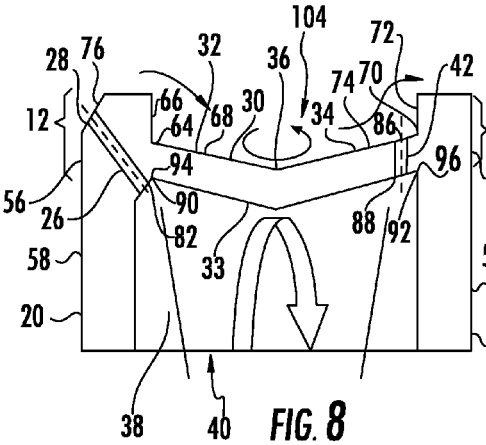
FIG. 8 is a partial cross-sectional view of yet another embodiment of the squealer tip taken at section line 8-8 in FIG. 4.
Figure 9:
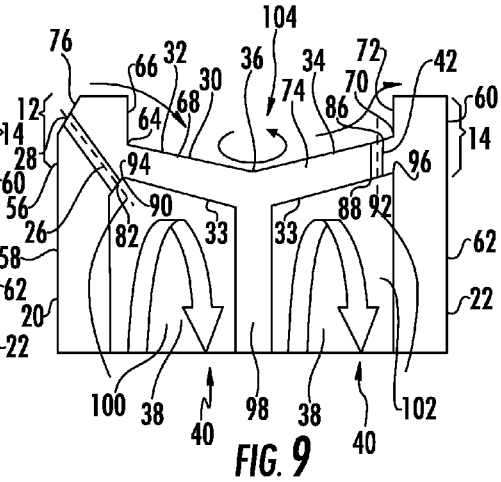
FIG. 9 is a partial cross-sectional view of still another embodiment of the squealer tip taken at section line 9-9 in FIG. 4.

The inner surface 33 of the axially extending tip wall 30 which forms a radially outer boundary of the cavity 38 forming the internal cooling system 40 has a convex surface with radially outermost points 90, 92 of the convex surface 33 at intersections 94, 96 with the pressure and suction sidewalls 20, 22. The cavity 38 forming the internal cooling system 40 may include a radially extending midregion rib 98, as shown in FIGS. 6, 7 and 9, dividing the internal cooling system 40 into pressure and suction sides 100, 102.

During use, cooling fluids are passed into the internal cooling system 40. The cooling fluids may flow through the cooling system 40 and increase in temperature as the cooling fluids reduce the temperature of the materials forming the turbine blade 18. The cooling fluids may flow into the radially outermost points 90, 92 of the convex surface 33 at intersections 94, 96 with the pressure and suction sidewalls 20, 22 wherein at least a portion of the fluids may be exhausted from the cooling system 40 through film cooling holes 26 and 42 in the tip 16 of the turbine blade 18. The cooling fluids may cool the tip 16 through convection and may cool aspects of the squealer tip 10 by being exhausted through the film cooling holes 26 and 42. Hot gases flowing past the radially extending pressure side tip wall 12 enter into the external tip cavity 104, which provides for static pressure recovery and tip leakage flow reduction.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated airfoil having a leading edge, a trailing edge, a tip at a first end, and a root coupled to the airfoil at an end generally opposite the first end for supporting the airfoil and for coupling the airfoil to a disc, a pressure sidewall extending from the leading edge to the trailing edge and a suction sidewall extending from the leading edge to the trailing edge and positioned on an opposite side of the generally elongated airfoil from the pressure sidewall and at least one cavity forming an internal cooling system;

a squealer tip at the first end, wherein the squealer tip is formed from a radially extending pressure side tip wall with an outer surface that is flush with an outer surface of the pressure sidewall, a radially extending suction side tip wall with an outer surface that is flush with an outer surface of the suction sidewall, and an axially extending tip wall extending between the pressure side tip wall and the suction side tip wall;

wherein the axially extending tip wall is formed from at least two outer linear surfaces joined together at an intersection that form a concave axially extending tip wall;

wherein an inner surface of the axially extending tip wall which forms a radially outer boundary of the at least one cavity forming the internal cooling system has a convex surface with radially outermost points of the convex surface at intersections with the pressure and suction sidewalls.

2. The turbine blade of claim 1, wherein the intersection at which the two outer linear surfaces forming the axially extending tip wall are joined is positioned radially inward from an intersection of an inner surface of the radially extending pressure side tip wall and an outer first surface of the axially extending tip wall and radially inward from an intersection of an inner surface of the radially extending suction side tip wall and an outer second surface of the axially extending tip wall.

3. The turbine blade of claim 1, wherein the radially extending pressure side tip wall includes a chamfered surface positioned at an acute angle relative to the outer surface of the generally elongated airfoil forming the pressure sidewall.

4. The turbine blade of claim 3, wherein the chamfered surface of the radially extending pressure side tip wall only extends for a portion of an entire length of the radially extending pressure side tip wall.

5. The turbine blade of claim 3, wherein the radially extending pressure side tip wall extends from the leading edge and terminates at the trailing edge.

6. The turbine blade of claim 3, further comprising at least one film cooling hole positioned in the radially extending pressure side tip wall with an outlet in the outer surface in the radially extending pressure side tip wall and an inlet that couples the at least one film cooling hole with the at least one cavity forming the internal cooling system.

7. The turbine blade of claim 6, wherein the outlet of the at least one film cooling hole is positioned in the chamfered surface of the radially extending pressure side tip wall.

8. The turbine blade of claim 1, further comprising at least one film cooling hole positioned in the radially extending pressure side tip wall with an outlet in the outer surface in the radially extending pressure side tip wall and an inlet that couples the at least one film cooling hole with the at least one cavity forming the internal cooling system.

9. The turbine blade of claim 1, wherein the radially extending suction side tip wall extends from the trailing edge toward the leading edge of the generally elongated airfoil, terminates at the leading edge and is coupled to the radially extending pressure side tip wall.

10. The turbine blade of claim 1, further comprising at least one film cooling hole positioned in an outer linear surface of the axially extending tip wall in contact with the radially extending suction side tip wall, wherein the at least one film cooling hole includes an outlet in the axially extending tip wall and an inlet that couples the at least one film cooling hole with the at least one cavity forming the internal cooling system.

11. The turbine blade of claim 1, wherein the at least one cavity forming the internal cooling system includes a radially extending midregion rib dividing the internal cooling system into pressure and suction sides.

12. A turbine blade, comprising:

a generally elongated airfoil having a leading edge, a trailing edge, a tip at a first end, and a root coupled to the blade at an end generally opposite the first end for supporting the blade and for coupling the blade to a disc, a pressure sidewall extending from the leading edge to the trailing edge and a suction sidewall extending from the leading edge to the trailing edge and positioned on an opposite side of the generally elongated airfoil from the pressure sidewall and at least one cavity forming an internal cooling system;

a squealer tip at the first end, wherein the squealer tip is formed from a radially extending pressure side tip wall with an outer surface that is flush with an outer surface of the pressure sidewall, a radially extending suction side tip wall with an outer surface that is flush with an outer surface of the suction sidewall, and an axially extending tip wall extending between the pressure side tip wall and the suction side tip wall;

wherein the axially extending tip wall is formed from at least two outer linear surfaces joined together at an intersection that form a concave axially extending tip wall;

at least one film cooling hole positioned in the radially extending pressure side tip wall with an outlet in the outer surface in the radially extending pressure side tip wall and an inlet that couples the at least one film cooling hole with the at least one cavity forming the internal cooling system;

at least one film cooling hole positioned in an outer linear surface of the axially extending tip wall in contact with the radially extending suction side tip wall, wherein the at least one film cooling hole includes an outlet in the axially extending tip wall and an inlet that couples the at least one film cooling hole with the at least one cavity forming the internal cooling system; and wherein an inner surface of the axially extending tip wall which forms a radially outer boundary of the at least one cavity forming the internal cooling system has a convex surface with radially outermost points of the convex surface at intersections with the pressure and suction sidewalls.

13. The turbine blade of claim 12, wherein the intersection at which the two outer linear surfaces forming the axially extending tip wall are joined is positioned radially inward from an intersection of an inner surface of the radially extending pressure side tip wall and an outer first surface of the axially extending tip wall and radially inward from an intersection of an inner surface of the radially extending suction side tip wall and an outer second surface of the axially extending tip wall.

14. The turbine blade of claim 12, wherein the radially extending pressure side tip wall includes a chamfered surface positioned at an acute angle relative to the outer surface of the generally elongated airfoil forming the pressure sidewall.

15. The turbine blade of claim 14, wherein the chamfered surface of the radially extending pressure side tip wall only extends for a portion of an entire length of the radially extending pressure side tip wall.

16. The turbine blade of claim 14, wherein the radially extending pressure side tip wall extends from the leading edge and terminates at the trailing edge.

17. The turbine blade of claim 16, wherein the outlet of the at least one film cooling hole is positioned in the chamfered surface of the radially extending pressure side tip wall.

18. The turbine blade of claim 12, wherein the radially extending suction side tip wall extends from the trailing edge toward the leading edge of the generally elongated airfoil, terminates at the leading edge and is coupled to the radially extending pressure side tip wall.

19. The turbine blade of claim 12, wherein the at least one cavity forming the internal cooling system includes a radially extending midregion rib dividing the internal cooling system into pressure and suction sides.

* * * * *